US012559942B2

(12) United States Patent
St. Germain et al.

(10) Patent No.: US 12,559,942 B2
(45) Date of Patent: Feb. 24, 2026

(54) SELF-SPACING LAP AND PANEL SIDING

(71) Applicant: LOUISIANA-PACIFIC CORPORATION, Nashville, TN (US)

(72) Inventors: Brian St. Germain, Mt. Juliet, TN (US); Paul Merrick, Gig Harbor, WA (US); Lance Olson, Saginaw, MN (US)

(73) Assignee: LOUISIANA-PACIFIC CORP., Nashville, TN (US)

( * ) Notice: Subject to any disclaimer, the term of this patent is extended or adjusted under 35 U.S.C. 154(b) by 0 days.

(21) Appl. No.: 17/170,713

(22) Filed: Feb. 8, 2021

(65) Prior Publication Data

US 2021/0246656 A1 Aug. 12, 2021

Related U.S. Application Data

(60) Provisional application No. 62/970,734, filed on Feb. 6, 2020.

(51) Int. Cl.
*E04C 2/30* (2006.01)
*E04B 2/00* (2006.01)
(Continued)

(52) U.S. Cl.
CPC ..... *E04C 2/30* (2013.01); *E04C 2/44* (2013.01); *E04F 13/0894* (2013.01); *E04C 2002/001* (2013.01)

(58) Field of Classification Search
CPC ..... E04C 2/30; E04C 2/44; E04C 2002/001; E04F 13/0894; E04F 15/02038;
(Continued)

(56) References Cited

U.S. PATENT DOCUMENTS 1,931,706 A 10/1933 Schaffert
2,276,170 A 3/1942 Elmendorf
(Continued)

OTHER PUBLICATIONS https://www.lowes.com/n/how-to/install-vinyl-siding , Oct. 28, 2019.*
(Continued)

*Primary Examiner* — Brian E Glessner
*Assistant Examiner* — Adam G Barlow
(74) *Attorney, Agent, or Firm* — Wayne Edward Ramage; Baker Donelson

(57) ABSTRACT

A lap siding or panel siding product with a unique shiplap joint that spaces abutting pieces of lap siding correctly from each other without measurements taken or needed by the installer. The shiplap joint comprises a bottom element and a top element, each extending from the respective piece of lap or panel siding. A set of "tabs" or "hook-tabs" is engineered on or adjacent to the underside of each joint element to space the pieces of lap or panel siding correctly, without requiring measurement during installation. The locations of the tabs or hook-tabs serve as a stop point for placement of the two pieces of lap or panel siding, allowing self-indexing. Post-installation, as the siding pieces expand or elongate length-wise or laterally, the two tabs or hook-tabs move away from each other, thereby allowing expansion and/or elongation without distortion or warping of the siding pieces.

19 Claims, 6 Drawing Sheets

(51) Int. Cl.
*E04F 13/08* (2006.01)
*E04C 2/00* (2006.01)

(58) Field of Classification Search
CPC ..... E04B 2002/0228; E04B 2002/0226; E04B 2002/0204
USPC ..... 52/588.1, 589.1, 590.1, 591.4, 592.1
See application file for complete search history.

(56) References Cited

U.S. PATENT DOCUMENTS 2,711,970 A * 6/1955 Hollmann ..... E04D 3/351 427/202
3,034,261 A * 5/1962 Hollmann ..... E04F 13/007 52/302.1
3,200,553 A * 8/1965 Frashour ..... E04F 15/04 52/592.4
5,930,964 A * 8/1999 Boehning ..... E04C 1/41 52/375
6,029,415 A * 2/2000 Culpepper ..... E04F 13/0864 52/522
6,880,307 B2 * 4/2005 Schwitte ..... E04F 15/02 52/592.1
RE39,439 E * 12/2006 Pervan ..... E04F 15/02 52/480
7,188,456 B2 * 3/2007 Knauseder ..... E04F 15/02 52/592.1
7,270,497 B2 * 9/2007 Von Langsdorff ..... E01C 5/06 404/34
7,444,791 B1 * 11/2008 Pervan ..... E04F 15/02044 52/592.2
7,762,040 B2 * 7/2010 Wilson ..... E04F 13/0801 52/553
7,926,239 B2 * 4/2011 Hahn ..... E04F 15/02033 52/592.1
8,191,328 B1 * 6/2012 Liu ..... E04F 15/04 52/390
8,268,110 B2 * 9/2012 Pien ..... E04B 5/026 156/196
8,375,672 B2 * 2/2013 Hannig ..... E04F 15/02038 52/591.1
8,756,899 B2 * 6/2014 Nilsson ..... E04F 15/105 52/592.1
8,806,832 B2 * 8/2014 Kell ..... E04G 23/0285 52/592.4
9,127,459 B2 * 9/2015 Litral ..... B44C 5/04
9,371,653 B2 * 6/2016 Liu ..... E04F 15/02033
9,567,755 B2 * 2/2017 Ramachandra ..... E04F 15/206
9,650,792 B2 * 5/2017 Ramachandra ... E04F 15/02022
9,663,954 B1 * 5/2017 Fernandez ..... E04D 1/16
9,695,599 B2 * 7/2017 Cappelle ..... E04F 15/02
9,988,821 B2 * 6/2018 Rose ..... B32B 3/30
10,544,594 B2 * 1/2020 Merrick ..... E04F 13/0892
2003/0014936 A1 1/2003 Watanabe
2005/0193679 A1 * 9/2005 Langsdorff ..... E01C 5/06 52/605
2006/0101768 A1 5/2006 Watson et al.
2008/0155928 A1 7/2008 Weiss
2009/0126308 A1 * 5/2009 Hannig ..... B27F 1/04 52/588.1
2009/0301022 A1 * 12/2009 Rockwell ..... D04H 1/4218 52/794.1
2010/0281810 A1 * 11/2010 Ruland ..... E04F 15/02 52/588.1
2012/0240502 A1 * 9/2012 Wilson ..... E04F 15/14 52/416
2012/0272603 A1 * 11/2012 Carbines ..... E04F 13/0892 52/748.1
2015/0121799 A1 * 5/2015 Imbeau ..... E04B 1/80 52/309.4
2016/0017612 A1 * 1/2016 Stafford ..... E04F 13/0894 52/588.1
2016/0228965 A1 * 8/2016 Ciampa ..... B23K 33/00

OTHER PUBLICATIONS

International Search Report and Written Opinion, PCT/US2018/028181, Louisiana-Pacific Corporation, international filing date Apr. 18, 2018.

* cited by examiner

LINEAR EXPANSION

SELF-SPACING LAP AND PANEL SIDING

This application claim benefit of and priority to U.S. Provisional Application No. 62/970,734, filed Feb. 6, 2020. U.S. Provisional Application No. 62/970,734 is incorporated herein in its entirety by specific reference for all purposes.

FIELD OF INVENTION

This invention relates to a lap or panel siding product with a unique self-indexing shiplap joint that spaces abutting pieces correctly from each other without installer measurements.

SUMMARY OF INVENTION

In various exemplary embodiments, the present invention comprises a lap siding or panel siding product with a unique shiplap joint that spaces abutting pieces of lap siding correctly from each other without measurements taken or needed by the installer. The shiplap joint comprises a bottom element and a top element, each extending from the respective piece of lap or panel siding. Each piece of lap or panel siding or board has a bottom element (i.e., under-lap) for a shiplap joint at one end, and a top element (i.e., over-lap) for a shiplap joint at the other end. The corresponding ends of two abutting lap or panel siding or boards (i.e., one providing an under-lap or bottom element, and the other providing an over-lap or top element) together form the unique shiplap joint of the present invention. Examples of shiplap joints are disclosed in U.S. patent application Ser. No. 16/775,010, filed Jan. 28, 2020, and Ser. No. 16/858,870, filed Apr. 27, 2020, and U.S. Pat. No. 10,544,594, issued Jan. 28, 2020, all of which are incorporated herein in their entireties by specific reference for all purposes.

A set of "tabs" or "hook-tabs" is engineered on or adjacent to the underside of each joint element to space the pieces of lap or panel siding correctly, without requiring measurement during installation. The tabs or hook-tabs form a wedge or face on the respective top or bottom element, with corresponding tabs or hook-tabs on the corresponding element meeting and stopping at a particular point as the two pieces of lap siding or panel are pulled laterally apart (i.e., self-indexing). The tab or hook-tab wedge or face may be substantially orthogonal to the face of the respective top or bottom element. In some embodiments, the hook-tab may form a reverse-angle wedge or face on the respective top or bottom element, with corresponding hook-tabs meeting and stopping as described above. The tabs or hook-tabs may be a section of wood (or whatever material is used for the lap or panel siding) cut-out, engineered, or otherwise integrated with the corresponding piece of siding, although in some embodiment, the tabs or hook-tabs may be separate and affixed, attached or added to the siding in the proper positions.

The locations of the tabs or hook-tabs serve as a stop point for placement of the two pieces of lap or panel siding, and are strong enough to allow proper placement of the two pieces of siding at the proper distance (as indicated by the front-side spacing between the siding pieces) during installation. The pieces thus are self-indexing. As described below in more detail, post-installation, as the siding pieces expand or elongate length-wise or laterally, the two tabs or hook-tabs move away from each other, thereby allowing expansion and/or elongation without distortion or warping of the siding pieces.

DETAILED DESCRIPTION OF EXEMPLARY EMBODIMENTS

Figure 1:
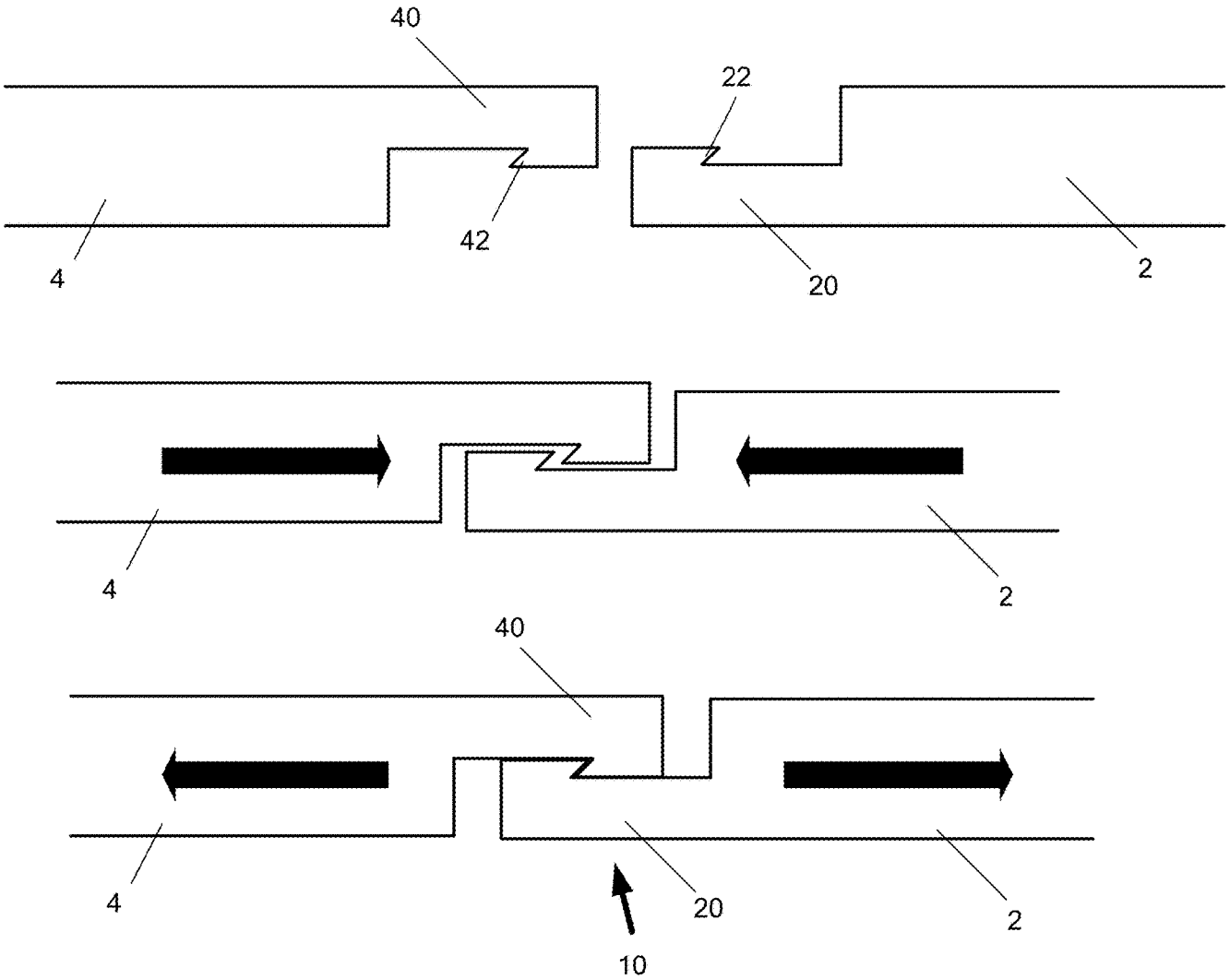
FIG. 1 shows a cross-section view of a lap or panel siding product with self-indexing hook-tabs in accordance with an embodiment of the present invention.

In various exemplary embodiments, as seen in FIG. 1, the present invention comprises a lap siding or panel siding product with corresponding components of a unique shiplap joint 10 that spaces abutting pieces of lap siding 2, 4 correctly from each other without measurements taken or needed by the installer. The shiplap joint 10 comprises a bottom element 20 and a top element 40, each extending from the respective piece of lap or panel siding 2, 4. Each piece of lap or panel siding or board has a bottom element 20 (i.e., under-lap) for a shiplap joint at one end, and a top element 40 (i.e., over-lap) for a shiplap joint at the other end. The corresponding ends of two abutting lap or panel siding or boards (i.e., one providing an under-lap or bottom element, and the other providing an over-lap or top element) together form the unique shiplap joint of the present invention.

A set of "tabs" or "hook-tabs" 22, 42 is engineered on or adjacent to the inner side or underside of each joint element 20, 40 to space the pieces of lap or panel siding correctly, without requiring measurement during installation. The tabs or hook-tabs form a wedge or face on the respective top or bottom element, with corresponding tabs or hook-tabs on the corresponding element meeting and stopping at a particular point as the two pieces of lap siding or panel are pulled laterally apart (i.e., the siding is self-indexing).

Figure 3:
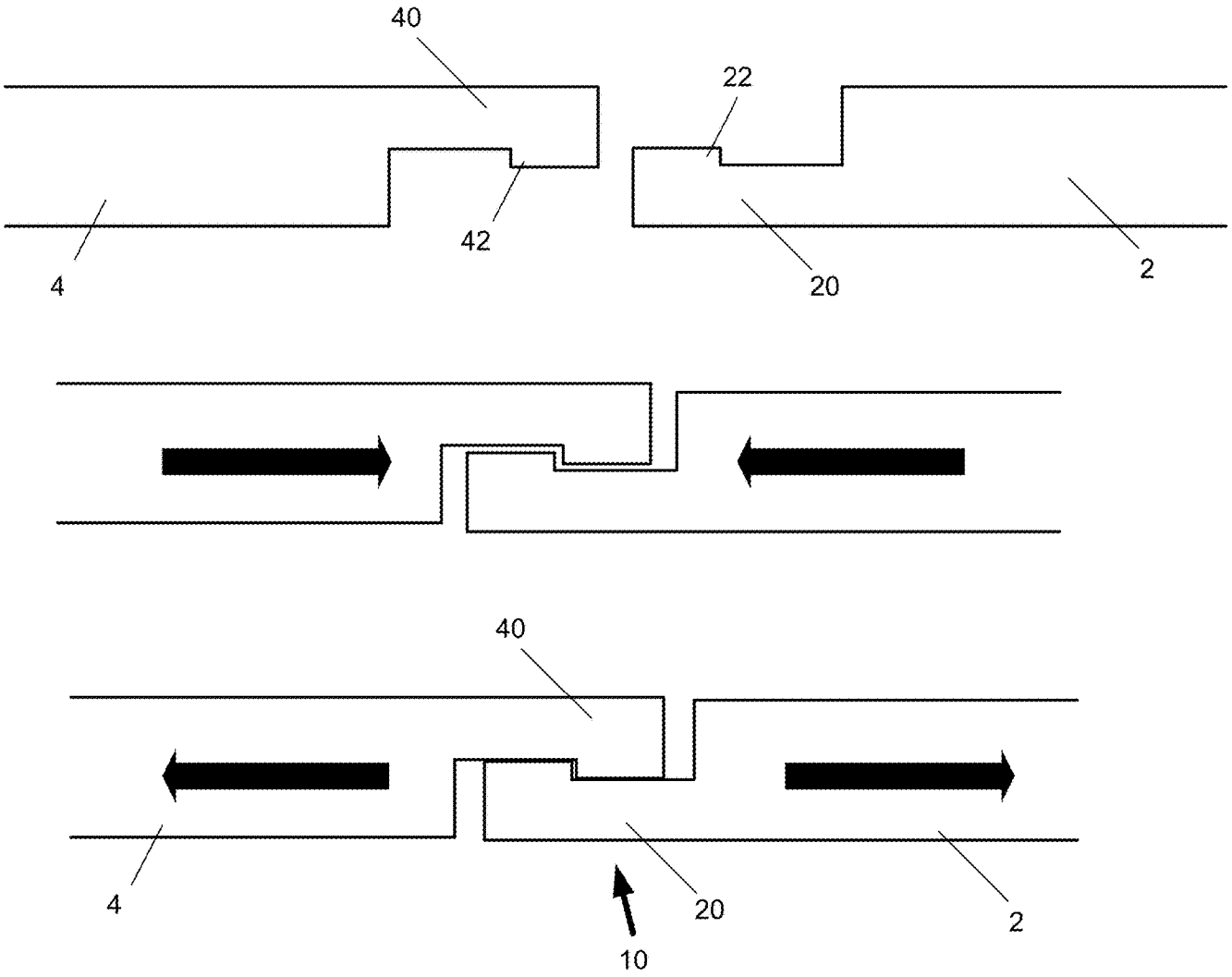
FIG. 3 shows a cross-section view of a lap or panel siding product with self-indexing tabs in accordance with an embodiment of the present invention.

The tab or hook-tab wedge or face may be substantially orthogonal to the face of the respective top or bottom element, as seen in FIG. 3. In some embodiments, the hook-tab may form a reverse-angle wedge or face on the respective top or bottom element, as seen in FIG. 1, with corresponding hook-tabs meeting and stopping as described above. The tabs or hook-tabs may be a section of wood (or whatever material is used for the lap or panel siding) cut-out, engineered, or otherwise integrated with the corresponding piece of siding, although in some embodiment, the tabs or hook-tabs may be separate and affixed, attached or added to the siding in the proper positions.

Figure 4:
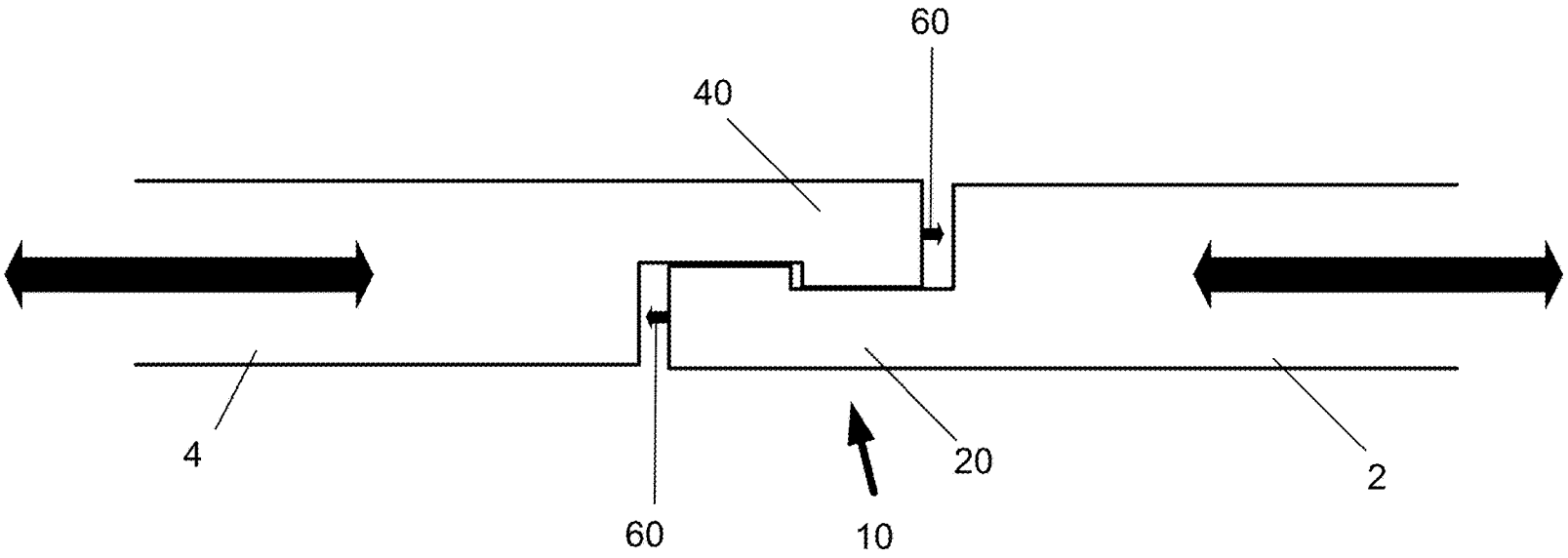
FIG. 4 shows a cross-section view of the product of FIG. 3 undergoing linear expansion.
Figure 5:
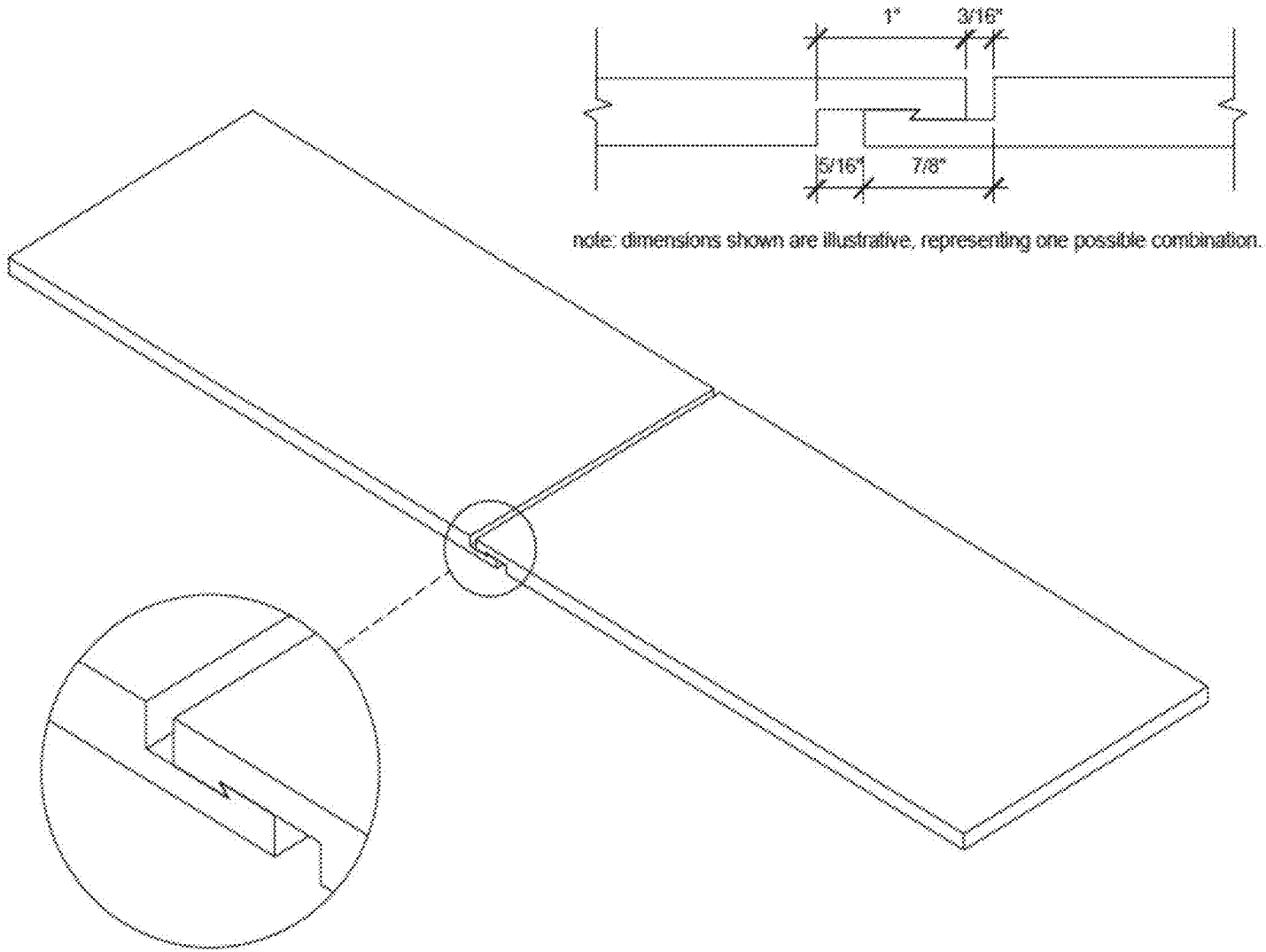
FIG. 5 shows a perspective view of a lap or panel siding product with self-indexing hook-tabs.
Figure 6:
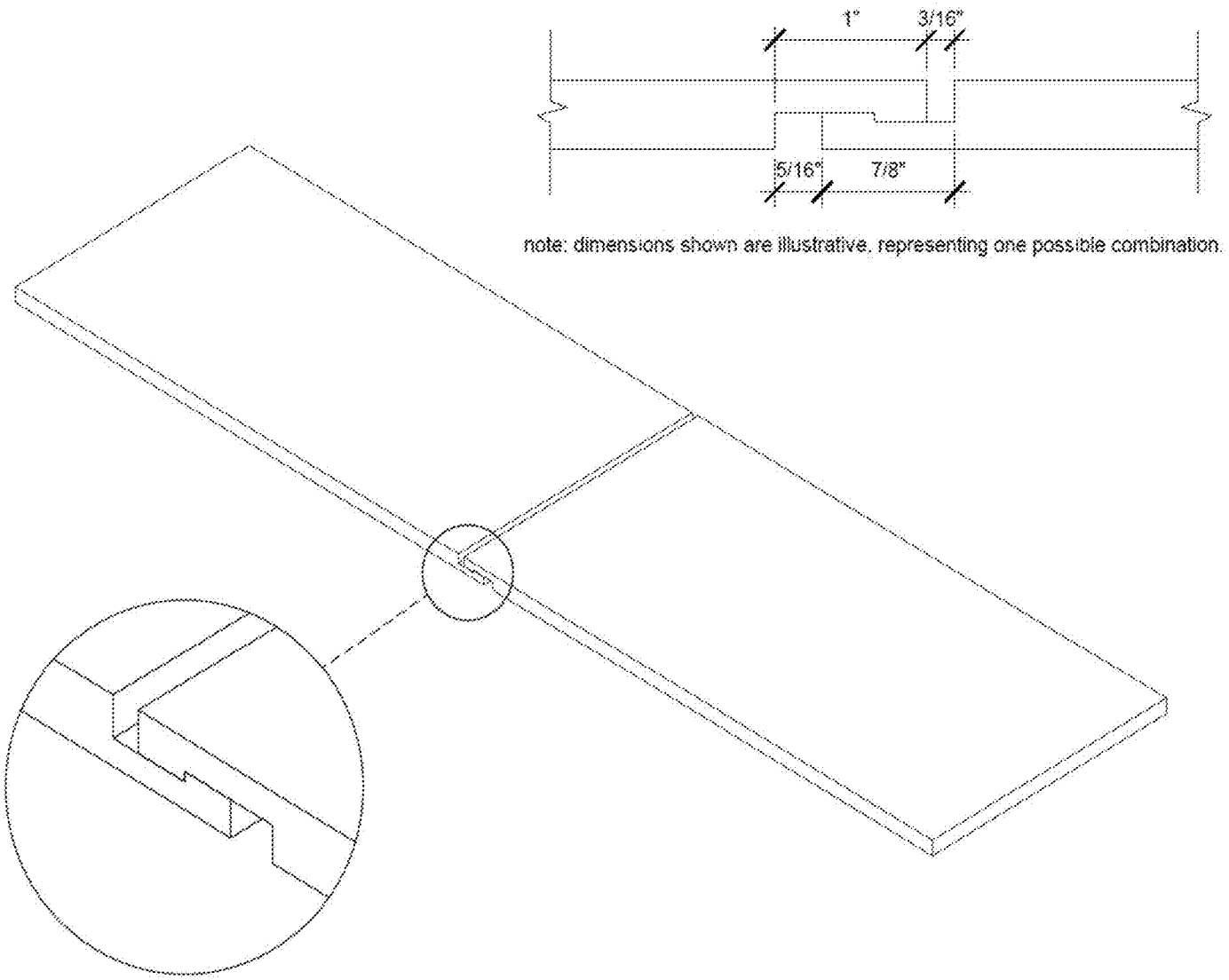
FIG. 6 shows lap or panel siding product with self-indexing tabs.

The locations of the tabs or hook-tabs 22, 24 serve as a stop point for placement of the two pieces of lap or panel siding 2, 4, and are strong enough to allow proper placement of the two pieces of siding at the proper distance (as indicated by the front-side spacing between the siding pieces) during installation. The pieces thus are self-indexing. As described below in more detail, post-installation, as the siding pieces expand or elongate length-wise or laterally 60, as seen in FIG. 4 the two tabs or hook-tabs move away from each other, thereby allowing expansion and/or elongation without distortion or warping of the siding pieces.

As seen in the figures, the abutting lap or panel siding can be equal or approximately equal in thickness. In one exemplary embodiment, the siding section total thickness ranges from ¼" to 1¼", while the tabs or tab-hooks are located to provide 1/16" to ½" spacing. The relative thicknesses of the under-lap and over-lap joint elements may vary, but as shown in the figures, together equal the siding section thickness. In one embodiment, the under-lap thickness ranges from approximately 20% to approximately 80% of the total siding section thickness, while the over-lap thickness is approximately equal to the total siding section thickness less the under-lap thickness (i.e., the corresponding bottom or top element comprises the remaining percentage of that thickness).

Figure 2:
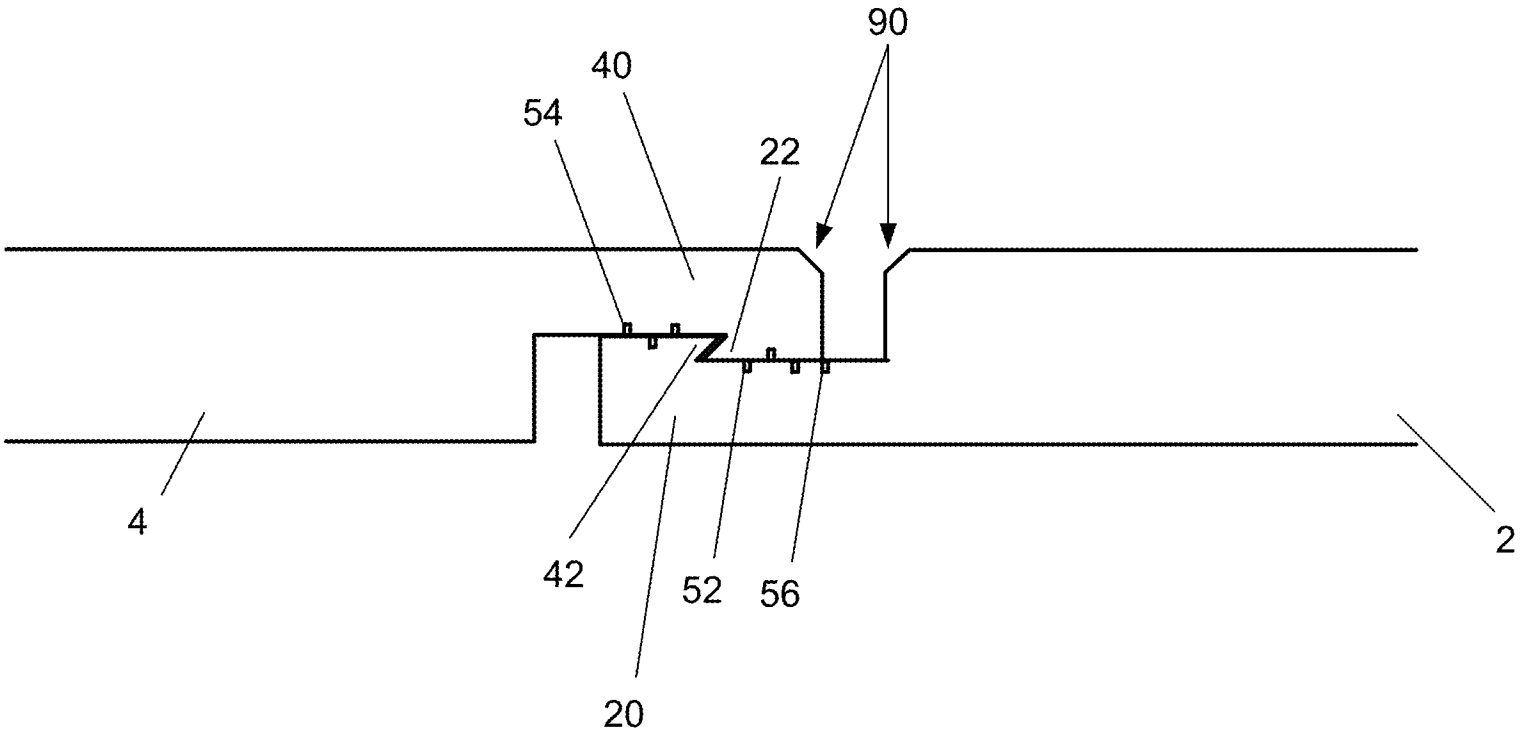
FIG. 2 shows another cross-section view of a lap or panel siding product with grooves and beveled corners in accordance with another embodiment of the present invention.

A groove or channel 52 may be machined or cut into the outer/upper face of the under-lap or bottom element 20, as seen in FIG. 2. This groove or channel serves as an integrated water drainage channel helping to prevent water or moisture from migrating through the joint itself behind the siding panels (i.e., water traveling from the exterior migrates to the channel, where it then travels down the channel and out). The groove or channel may be located appropriately to also serve as a visual indexing line for proper gapping of the siding panels during installation. The location of the groove or channel can be elsewhere on the face of the bottom element (or even on the underside 54 of the top element) if use as a visual indexing line is not required. In several embodiments, multiple grooves or channels may be provided. If multiples are provided, one may be positioned to serve as a visual indexing line 56, as described above, in addition to or in conjunction with the physical self-indexing of the tabs or hook-tabs. The groove(s) or channel(s) may be of any suitable size or configuration (e.g., ⅛" to 3/16" wide by up to ⅛" in depth, in the embodiment shown). They may extend straight across the width of the siding panel, or form a sine wave, alternating angles, or other patterns. Where multiple grooves or channels are used, they may not intersect, or some or all may intersect to form various grids or patterns. They also may all be of the same size or configuration, or may vary (i.e., different widths and depths).

After installation, as the pieces of siding expand or contract upon exposure to various weather conditions, the siding panels often will expand or elongate length-wise. In prior art joints, this expansion may lead to buckling or distortion in the lap or panel siding and in the joints. With the present invention, the tabs or hook-tabs move away from each other, as seen in FIG. 4, thereby allowing expanding or elongation in the pieces of siding through the joint without resulting or causing buckling or distortion in the siding panels themselves or in their joints.

In a further embodiment, as seen in FIG. 2, the joint edges on the outer faces of each panel are beveled or rounded 90. This creates a smoother visual appearance of the siding when installed. The angle of the beveling may be at any appropriate angle (e.g., 5 to 85 degrees), depending on the facial appearance or treatment of the panels. In one exemplary embodiment, the beveling is between 30 to 60 degrees with respect to the outer face.

The present invention also eliminates the need for caulk, pan flashing or joint covers in or on the joint between the pieces of siding or cladding, as the design of the joint addresses weather-related buckling and expansion and water intrusion. The design and/or shape of the joint reduces the intrusion of water, and re-directs water down and out from behind the siding.

The siding or cladding may be manufactured from a variety of materials utilized for such purposes, including, but not limited to, wood, wood fibers, engineered wood composites, and cellulose fiber cement, alone or in various combinations.

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

What is claim is:

1. A lap or panel siding system, comprising:

a pair of lap or panel siding pieces, each piece comprising an outer face, an inner face, a first end and a second end, wherein the first end of one piece is configured to meet with and form a shiplap joint with the second end of the other piece;

wherein the first end of each piece comprises an over-lap shiplap joint element with an inner face, and the second end of each piece comprises an under-lap shiplap joint element with an inner face, wherein the over-lap element overlaps in whole or in part a corresponding under-lap element when forming the shiplap joint;

wherein the over-lap element and the under-lap element each comprise a corresponding self-indexing stop disposed on the inner face of each, configured to position the respective ends at a pre-determined spacing distance by mutual contact of the corresponding self-indexing stops when forming the shiplap joint, wherein the over-lap element and the under-lap element do not interlock when forming the shiplap joint;

further wherein said pre-determined spacing distance creates a visible first gap at least 3/16" in width between the edges of said outer faces of the pair of lap or panel siding pieces, and a second gap between the edges of said inner faces of the pair of lap or panel siding pieces, wherein the second gap is wider than the first gap;

further wherein the first gap and the second gap are configured to allow lengthwise expansion of the pair of lap or panel siding pieces at the shiplap joint without distortion or warping of the siding pieces; and further wherein the overlap-element and the under-lap element are configured to allow lengthwise expansion independent of each other, wherein the lengthwise expansion of either of said pair of lap or panel siding pieces does not impact or cause the movement of the other of said pair of lap or panel siding pieces or any lap or panel siding pieces adjacent thereto.

2. The system of claim 1, wherein the over-lap element and the under-lap element are equal in thickness.

3. The system of claim 1, wherein the over-lap element is thicker than the under-lap element.

4. The system of claim 1, wherein the over-lap element is thinner than the under-lap element.

5. The system of claim 1, wherein the self-indexing stop comprises a face or edge orthogonal to the inner face of the respective element.

6. The system of claim 1, wherein the self-indexing stop comprises a face or edge forming a reverse angle with respect to the inner face of the respective element.

7. The system of claim 1, wherein the self-indexing stop extends across the full width of the inner face of the respective element.

8. The system of claim 1, wherein the self-indexing stop extends at least partially across the full width of the inner face of the respective element.

9. The system of claim 1, the under-lap shiplap joint element comprising one or more first drainage grooves extending laterally across the inner face of the under-lap shiplap joint element.

10. The system of claim 1, the over-lap shiplap joint element comprising one or more second drainage grooves extending laterally across the inner face of the under-lap shiplap joint element.

11. The system of claim 1, further comprising beveled edge where the outer face of each piece of siding meets the corresponding shiplap joint element.

12. A method of installing two pieces of lap siding to form a shiplap joint, comprising:

providing a pair of lap or panel siding pieces as set forth in claim 1, each pair comprising a first siding piece and a second siding piece, each piece comprising an outer face, an inner face, a first end and a second end, the first end comprising an over-lap shiplap joint element with an inner face and a first self-indexing stop thereon, and the second end comprising an under-lap shiplap joint element with an inner face and a second self-indexing stop thereon, wherein the over-lap shiplap joint element overlaps in whole or in part the corresponding under-lap shiplap joint element when forming a shiplap joint, wherein the over-lap element and the under-lap element do not interlock when forming the shiplap joint, and are configured to allow lengthwise expansion independent of each other;

affixing the first siding piece to a structure so that the second end of the first siding piece is exposed;

placing the second siding piece adjacent to the first siding piece so that the first end of the second siding piece overlaps the second end of the first siding piece;

moving the second siding piece towards the first siding piece so the first self-indexing stop on the first end of the second piece is disposed between a center of the first siding piece and the second self-indexing stop on the second end of the first siding piece;

moving the second siding piece away from the first siding piece in a sliding manner until the first self-indexing stop on the first end of the second piece comes into contact with the second self-indexing stop on the second end of the first siding piece, thereby creating a visible first gap between the edges of said outer faces of the pair of lap or panel siding pieces, wherein the first gap is configured to allow independent lateral expansion and contraction of the corresponding ends of the pair of lap or panel siding pieces further wherein the overlap-element and the under-lap element are configured to allow lengthwise expansion independent of each other, wherein the lengthwise expansion of either of said pair of lap or panel siding pieces does not impact or cause the movement of the other of said pair of lap or panel siding pieces or any lap or panel siding pieces adjacent thereto; and affixing the second siding piece to the structure;

further wherein the step of moving the second siding piece away from the first siding piece also creates a second gap between the edges of the inner faces of the pair of lap or panel siding pieces, wherein the second gap is wider than the first gap.

13. The method of claim 12, wherein the over-lap element and the under-lap element are equal in thickness.

14. The method of claim 12, wherein the over-lap element is thicker than the under-lap element.

15. The method of claim 12, wherein the over-lap element is thinner than the under-lap element.

16. The method of claim 12, wherein the self-indexing stop comprises a face or edge orthogonal to the inner face of the respective element.

17. The method of claim 12, wherein the self-indexing stop comprises a face or edge forming a reverse angle with respect to the inner face of the respective element.

18. The method of claim 12, wherein the self-indexing stop extends across the full width of the inner face of the respective element.

19. The system of claim 1, further wherein said predetermined spacing distance creates a second gap between the edges of said inner faces of the pair of lap or panel siding pieces, wherein the second gap is at least 5/16".

* * * * *